US010227714B2

(12) United States Patent
Salitsky et al.

(10) Patent No.: US 10,227,714 B2
(45) Date of Patent: Mar. 12, 2019

(54) CONDUCTIVE MONOFILAMENT AND FABRIC

(75) Inventors: Joseph Salitsky, Mansfield, MA (US); Joseph G. O'Connor, Hopedale, MA (US); Maurice R. Paquin, Plainville, MA (US); Jonathan S. Barish, South Easton, MA (US)

(73) Assignee: Albany International Corp., Rochester, NH (US)

( * ) Notice: Subject to any disclaimer, the term of this patent is extended or adjusted under 35 U.S.C. 154(b) by 1024 days.

(21) Appl. No.: 12/132,092

(22) Filed: Jun. 3, 2008

(65) Prior Publication Data

US 2008/0318483 A1 Dec. 25, 2008

Related U.S. Application Data

(60) Provisional application No. 60/993,158, filed on Sep. 10, 2007, provisional application No. 60/933,548, filed on Jun. 7, 2007.

(51) Int. Cl.
*D01F 8/00* (2006.01)
*D03D 15/00* (2006.01)
(Continued)

(52) U.S. Cl.
CPC ..... *D01F 8/00* (2013.01); *D01D 5/253* (2013.01); *D01D 11/06* (2013.01);
(Continued)

(58) Field of Classification Search
CPC .... D01F 8/00; D01F 1/09; D01F 8/12; D03D 15/0005; D03D 15/0066; D03D 15/00; D01D 11/06; D01D 5/28; D01D 5/253; D06M 11/83; D06M 11/74; B32B 15/02; D02G 3/404; D02G 3/441; D02G 3/445; H01L 31/00; H01L 31/22; H01L 31/24; D06N 7/0042; A41D 31/0066; D06Q 1/04; D06Q 1/00; Y10S 57/901; Y10S 428/922; D10B 2101/20; D10B 2401/16; D04B 1/16; H01B 1/00; H01B 1/22; H01B 1/24
USPC ..... 442/189, 192, 195, 196, 308, 309, 335, 442/337, 30, 190, 59, 110, 6, 164, 229, 442/316, 389, 377; 428/375, 389, 372, 428/328, 299.7, 378, 394, 407, 373, 368,
(Continued)

(56) References Cited

U.S. PATENT DOCUMENTS 3,582,448 A 6/1971 Okuhashi et al.
3,842,465 A 10/1974 Sillaots et al.
(Continued)

FOREIGN PATENT DOCUMENTS

EP 0 386 975 A 9/1990
EP 1 091 026 A 4/2001
(Continued)

OTHER PUBLICATIONS

International Search Report/Written Opinion of PCT/US2008/065619 issued by European Patent Office dated Aug. 27, 2008.
(Continued)

*Primary Examiner* — Chinessa T. Golden
(74) *Attorney, Agent, or Firm* — McCarter & English, LLP

(57) ABSTRACT

A conductive monofilament and static dissipative fabric having the same wherein the monofilament includes electrically conductive material and binder and has static dissipation properties.

13 Claims, 4 Drawing Sheets

(51) Int. Cl.
*D06M 11/83* (2006.01)
*D01D 5/253* (2006.01)
*D01D 11/06* (2006.01)

(52) U.S. Cl.
CPC ..... *D03D 15/0005* (2013.01); *D03D 15/0066* (2013.01); *D06M 11/83* (2013.01); *D10B 2101/20* (2013.01); *D10B 2401/16* (2013.01); *Y10T 428/2958* (2015.01); *Y10T 442/109* (2015.04); *Y10T 442/3089* (2015.04); *Y10T 442/3114* (2015.04); *Y10T 442/339* (2015.04); *Y10T 442/475* (2015.04)

(58) Field of Classification Search
USPC .... 428/96, 334, 922, 402, 381; 57/244, 243, 57/250
See application file for complete search history.

(56) References Cited

U.S. PATENT DOCUMENTS

| | | | | |
|---|---|---|---|---|
| 3,854,983 | A | 12/1974 | Brodnyan | |
| 3,864,148 | A * | 2/1975 | Maeawa et al. | 427/217 |
| 4,216,264 | A * | 8/1980 | Naruse et al. | 428/397 |
| 4,303,733 | A * | 12/1981 | Bulle et al. | 428/367 |
| 4,803,096 | A | 2/1989 | Kuhn et al. | |
| 5,361,808 | A | 11/1994 | Bowen, Jr. | |
| 5,744,236 | A | 4/1998 | Rohrbach et al. | |
| 5,830,983 | A | 11/1998 | Alex et al. | |
| 5,985,450 | A | 11/1999 | Keller | |
| 5,998,310 | A | 12/1999 | Bowen, Jr. | |
| 6,093,491 | A | 7/2000 | Dugan et al. | |
| 6,242,094 | B1 | 6/2001 | Breznak et al. | |
| 6,352,772 | B1 | 3/2002 | Keller | |
| 6,413,634 | B1 * | 7/2002 | Tanaka et al. | 428/370 |
| 6,432,850 | B1 | 8/2002 | Takagi et al. | |
| 6,548,166 | B2 | 4/2003 | Figuly et al. | |
| 6,703,123 | B1 * | 3/2004 | Shibuta et al. | 428/375 |
| 2004/0053049 | A1 * | 3/2004 | Tsunashima et al. | 428/375 |
| 2004/0053552 | A1 | 3/2004 | Child et al. | |
| 2004/0197556 | A1 * | 10/2004 | Atwood et al. | 428/373 |
| 2005/0095935 | A1 * | 5/2005 | Levine et al. | 442/110 |

FOREIGN PATENT DOCUMENTS

| | | |
|---|---|---|
| GB | 2046775 A | 11/1980 |
| JP | 63-92777 A | 10/1986 |
| WO | WO 99/15725 | 4/1999 |
| WO | WO 00/75406 | 12/2000 |

OTHER PUBLICATIONS

"Industrial Fabrics Formation", *Engineering 360*, Access Date: May 18, 2016 http://www.globalspec.com/learnmore/materials_chemicals_adhesives/composites_textiles_reinforcements/industrial_fabrics.

"Industrial Fabric", *Article about Industrial Fabric by the Free Dictionary*, © 2003-2016 Farlex, Inc. Access Date: May 18, 2016 http://encyclopedia2.thefreedictionary.com/Industrial+Fabric.

"Film", *Merriam-Webster Dictionary*, © 2015 Merriam-Webster, Incorporated, Access Date: May 18, 2016 http://www.merriam-webster.com/dictionary/film.

"Channel", *Merriam-Webster Dictionary*, © 2015 Merriam-Webster, Incorporated, Access Date: May 31, 2016 http://www.merriam-webster.com/dictionary/channel.

"Channel", *MacMillian Dictionary*, Access Date : May 31, 2016 http://www.macmillandictionary.com/us/dictionary/american/channel_1.

Kumar, R. Senthil. *Textiles for Industrial Applications*, CRC Press. Taylor & Francis Group, LLC, Boca Raton, Florida, 2014, pp. 2, 11, 37 and 38.

* cited by examiner

CONDUCTIVE MONOFILAMENT AND FABRIC

CROSS-REFERENCE TO RELATED APPLICATIONS

This application claims priority benefits to U.S. Provisional Patent Application Ser. No. 60/993,158 filed Sep. 10, 2007 entitled "Conductive Monofilament and Fabric" and U.S. Provisional Patent Application Ser. No. 60/933,548 filed Jun. 7, 2007 entitled "Conductive Monofilament and Fabric", the disclosures of which are incorporated herein by reference.

FIELD OF THE INVENTION

The present invention is directed towards a conductive yarn and static dissipative fabric construction, particularly one that effectively dissipates static charge whilst also having desirable physical properties.

BACKGROUND OF THE INVENTION

Heretofore, conductive fabrics useful for, as an example, dissipation of static electricity, have incorporated monofilaments with high loadings of conductive materials, such as carbon black or metallic particulate. Typically, these conductive materials are either dispersed within a base polymer, such as polyethylene terephthalate and polyamide, or incorporated in polymeric coatings which are deposited over oriented monofilaments.

There are several limitations associated with these prior art methods. First, the conductivity of the loaded monofilaments is only in the range of $10^{-4}$-$10^{-7}$ S/cm, which is the bare minimum needed for effective dissipation of static charge. Unfortunately, this drawback limits the fabric design options, and also impairs fabric performance. A second disadvantage is that, in the case of fully filled products, there is a compromise of monofilament physical properties, such as modulus, tenacity and elongation. This is due to the high level of contamination caused by compounding levels greater than twenty percent of the conductive filler. This loss of physical properties, again, restricts the options for fabric design and negatively impacts fabric performance.

Other prior art conductive fabrics incorporate conductive coatings, metallic wire constructions, or combination designs incorporating metal fibers within a synthetic structure. There are, however, drawbacks also associated with these fabrics. For example, while these prior designs may dissipate static charge, it is noted that structures with metallic wires are difficult to manufacture. A further disadvantage is that metal-based fabrics are easily damaged, and in particular, incur unwanted dents and creases during use. Prior art coated designs, on the other hand, have suffered from a lack of durability and the coating can undesirably reduce the permeability of open mesh structures.

SUMMARY OF THE INVENTION

It is therefore a principal object of the invention to provide for yarns for use in industrial fabrics such as engineered fabrics used for example in airlaid, meltblown, spun bond production, and dryer fabrics used in papermaking and other industrial fabrics where the dissipation of static charge is necessary or desirable, and which avoids the problems aforementioned.

Another object of the invention is to provide for static dissipative yarns for use in the construction of power cables, such as for example oil well cables, high power transmission lines, as a grounding medium to prevent electrical charge build up during cable constructions, which otherwise has the potential to discharge causing equipment damage, serious injuries and/or deaths.

Yet another object of the invention is to provide for static dissipative yarns for use in construction of braided sleeves, consisting of various thermoplastic monofilaments, to protect, ground and electromagnetic interference (EMI) shield bundles of multipurpose electrical wires, in plenums, in aerospace applications; such as aircraft controls, lighting, and entertainment, and in automotive applications.

This and other objects and advantages are provided by the present invention. In this regard, the present invention is directed towards a durable, highly conductive polymeric monofilament or plied monofilament yarn used in fabric construction. Advantageously, the invention involves using functional monofilaments or plied monofilaments having a coating or film of a particular conductive material which includes metal particles and a binder. In one embodiment the monofilament includes one or more longitudinal grooves in which the coating or film is primarily located. As the yarns or monofilaments wear, the conductive material is maintained in the grooves and protected from wear. As a result, fabrics have static dissipation properties previously available only in metal-based fabrics, whilst also having physical and thermal properties comparable to conventional industrial fabrics. Consequently, the inventive fabric construction resists the denting and creasing associated with metallic fabric designs yet provides for superior static dissipation. The static dissipative quality, however, depends upon the coating thickness, level of conductivity of the coating material used, area of coating within the structure (surface, interior etc.), spacing of the monofilament grid and several other factors, which have been taken into consideration in the present invention.

BRIEF DESCRIPTION OF THE DRAWING

Thus by the present invention, its objects and advantages will be realized, the description of which should be taken in conjunction with the drawings wherein.

DETAILED DESCRIPTION OF THE PREFERRED EMBODIMENTS

A preferred embodiment of the present invention will be described in the context of engineered fabrics, such as fabrics used in making nonwoven textiles in the airlaid, meltblown and/or spunbonding processes wherein the release of the nonwoven product formed on the fabric is improved by the elimination of static buildup. However, it should be noted that the invention is also applicable to other industrial fabrics such as dryer fabrics used in papermaking and other fabrics used in any "dry" applications where the dissipation of static electricity is required, for instance, through the fabric media. Also since electrically conductive material is also a good thermal conductor, other applications are possible where thermal conductivity is desirable. Some examples where the instant conductive or static dissipative yarns can be used is in the construction of power cables, such as for example oil well cables, high power transmission lines, as a grounding medium to prevent electrical charge build up during cable constructions, which otherwise has the potential to discharge causing equipment damage, serious injuries and/or deaths. Yet another example is for use in construction of braided sleeves, consisting of various thermoplastic monofilaments, to protect, ground and electromagnetic interference (EMI) shield bundles of multipurpose electrical wires, in plenums, in aerospace applications, such as aircraft controls, lighting, and entertainment, and in automotive applications. Fabric constructions may include woven, MD or CD yarn arrays, knitted fabrics, spiral link assemblies, film or film like structures, extruded mesh, and spiral wound strips of materials of the aforesaid construction. It should be noted that these industrial fabrics are relatively large and are often subject to a very harsh environment. These fabrics may comprise monofilament, plied monofilament, multifilament or plied multifilament synthetic yarns, and may be single-layered, multi-layered, multi-layer woven or laminated.

Figure 1:
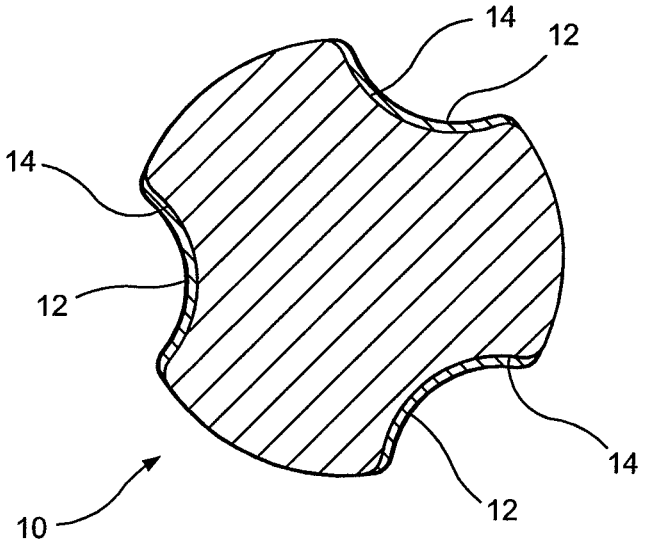
FIG. 1 is a cross-sectional view of a monofilament according to the teachings of the present invention.

Turning now more particularly to the drawing, the invention provides for fabrics comprising, as shown in FIG. 1 (cross-sectional view), a functional monofilament or yarn 10 containing electrically conductive material 12. Thus, whereas conductive material by itself may lack the strength to be formed into load bearing monofilaments 10, the invention in a preferred embodiment incorporates these materials 12 primarily in grooves 14 located along the longitudinal length of the monofilament 10. Advantageously, fabrics incorporating monofilaments 10 have static dissipation properties previously available only in metal-based fabrics whilst possessing physical properties equivalent to conventional industrial fabrics. Moreover, fabrics with these monofilaments 10 resist the denting and creasing heretofore associated with metal filament fabrics.

In particular, the invention incorporates the conductive material 12 in a binder. The material utilized is preferably a conductive ink or adhesive which is available, for example, from Engineered Conductive Materials, LLC, or Engineered Material Systems, Inc., 132 Johnson Drive, Delaware, Ohio 43015. This company provides many conductive inks and adhesives. A particularly useful one is a conductive ink using silver particles and a binder. The preferred product has designations CI-1020. Other conductive inks with other metals such as copper, nickel, zinc or their combinations may also be suitable for the purpose. The binder may be epoxy, acrylic, vinylidene chloride, copolymers of these or any other type binder suitable for the purpose.

Figure 3A:
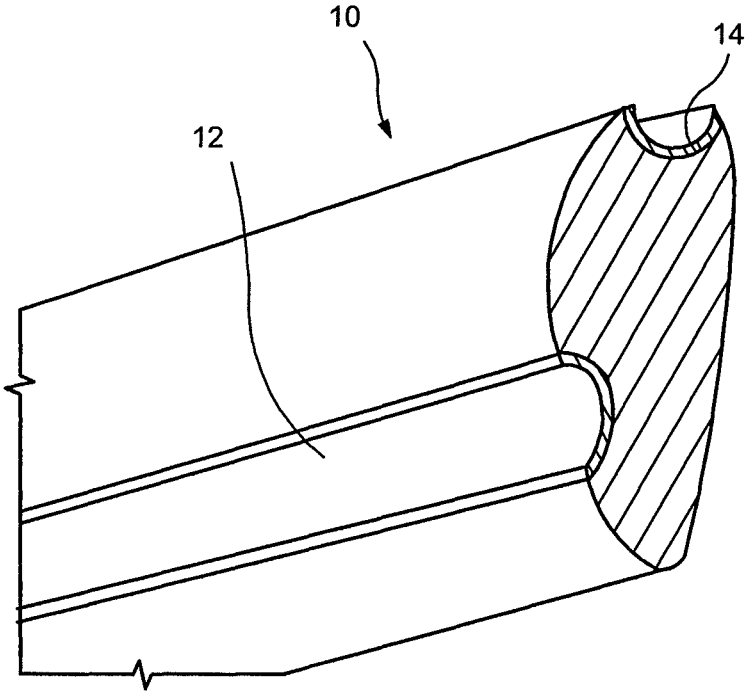
FIG. 3*a* is a cross-sectional view of a monofilament according to one aspect of the invention.
Figure 4:
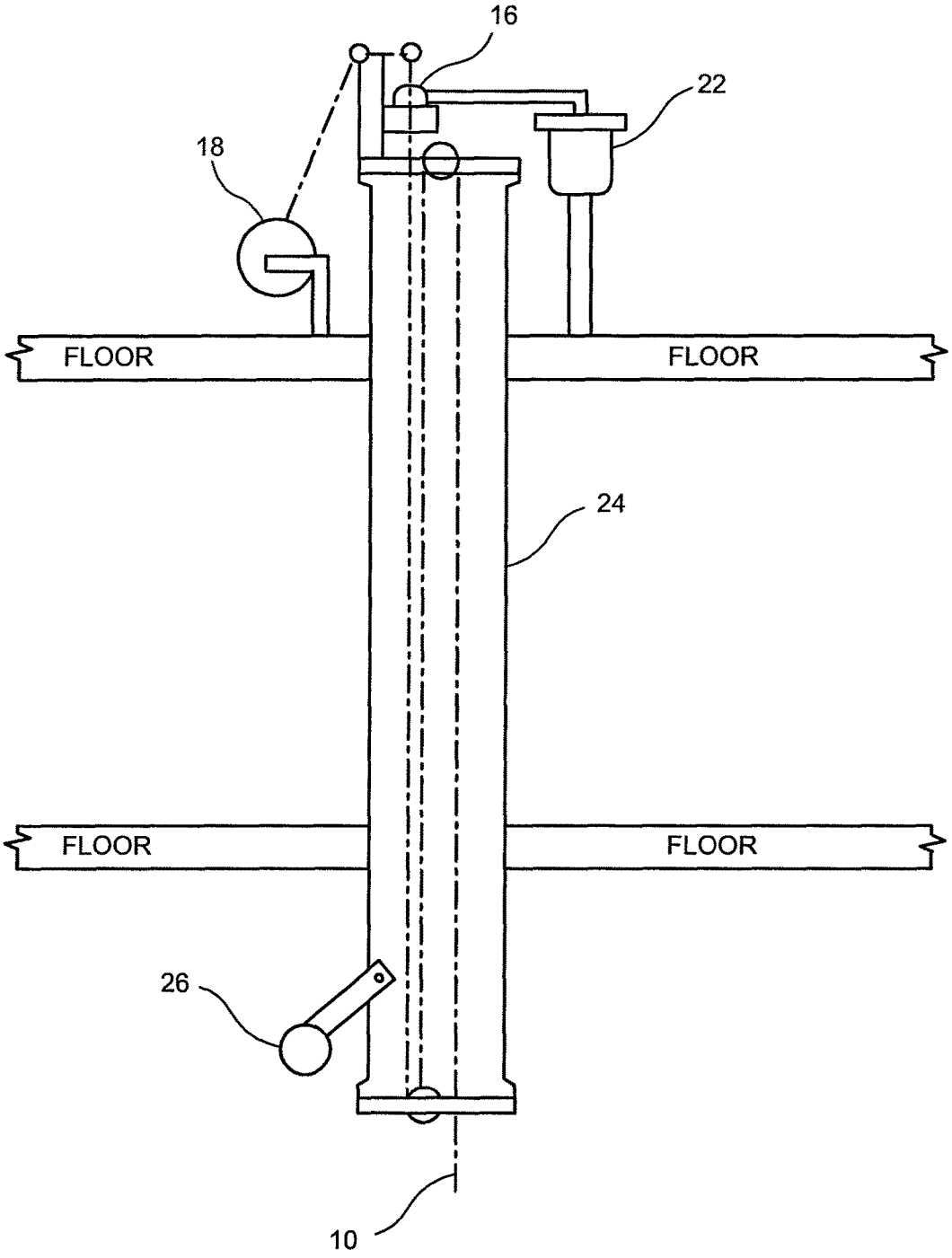
FIG. 4 is a somewhat schematic view of a die coating application method.

The conductive material 12 lines the grooves 14 and need not fill all thereof. The conductive material 12 needs however be continuous longitudinally in the grooves 14 to be effective. FIG. 3*a* illustrates a Scanning Electron Microscope (SEM) image of a preferred embodiment wherein the conductive material 12 is applied to the monofilament 10 as a coating or film. Techniques include, for example, dip or bath coating, spraying, jetting or other means suitable for the purpose. For example a die coating application method, as shown in FIG. 4, may be used where a controlled metering of the conductive material 12 and binder occurs to create a film on the surface of the monofilament, particularly in the groove area, with the internal circumference of the coating die being approximately the same as the outer circumference of the monofilament. FIG. 4 particularly shows an example of a conductive coating setup used in this process, wherein uncoated monofilament from a supply creel 18 is passed through a coating die 16, and a layer of coating of the conductive material 12, supplied from the conductive coating chamber 22, is applied simultaneously onto the monofilament. Metering is controlled by the dimension of the coating die 16 and the coating on the monofilament 10 is now dried in a controlled heating blanket 24 using a hot air blower 26, positioned within the drying chamber. The monofilament 10 is subsequently wound onto an output package (not shown in the figure). Note that while essentially round grooved monofilaments are preferred, other shapes are envisioned such as flat (e.g. rectangular), polygonal or other non-round shapes. Of these, however, shaped monofilaments with one or more grooves for the coating to reside in are preferred.

In the case of grooved monofilaments the conductive material with binder uniformly coats the grooves 14, which provides a continuous channel of conductive coating or film in the groove 14. One or more grooves may be utilized with three shown in FIG. 1 being merely illustrative.

Note that with the dye application process, the die is sized to the dimensions of the monofilament. This leads to the benefit of lower coat weight and lower costs due to the lower amount of material required. The groove 14 has the added benefit of protecting the conductive material 12, since the conductive material resides below the wear surface of the filament where abrasion may occur. In other applications, the coating may be on the outer surface.

Figure 2:
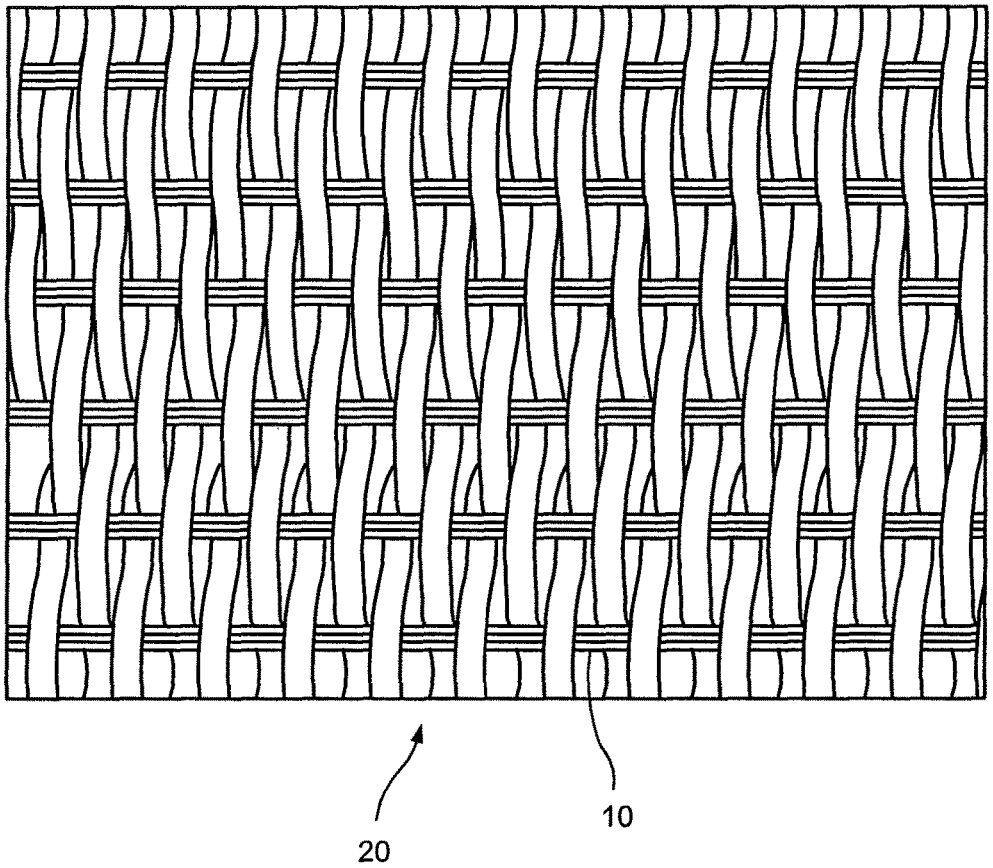
FIG. 2 is a plan of a fabric according to one aspect of the invention.

The result is a monofilament with electrical conductivity equivalent to that of metallic yarns achieved by way of a durable bonded, flex resistant, thin, low cost and protected conductive coating. The monofilament can be used as is or can be plied or twisted to form a plied monofilament structure according to the desired end usage. FIG. 2 shows a fabric 20 with the monofilament 10 in the cross machine direction, according to one embodiment of the invention.

Note that in incorporating these monofilaments in a fabric, they need not comprise all the yarns used but rather may only be a portion of the monofilaments making up the fabric. They may be used in the machine direction and/or the cross machine direction and in any weave pattern necessary for dissipating the static electricity for the application.

Figure 3B:
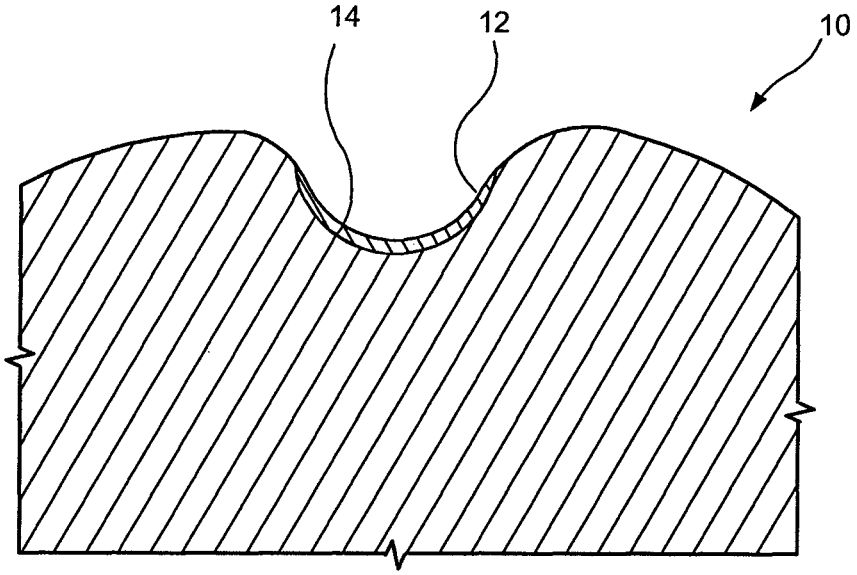
FIG. 3*b* is a cross-sectional view of a monofilament according to one aspect of the invention.

The embodiment shown cross-sectionally in a SEM image in FIG. 3*b* provides for coating a grooved monofilament 10 with the conductive material 12. Advantageously, this increases the monofilament's conductivity, whilst maintaining the monofilament's physical and functional properties. The conductive material 12 bonds to the surface of the monofilament along the circumference as well as within at least the perimeter of the groove(s). This grooved yarn arrangement serves to protect the conductive material 12 even as the monofilament 10 wears whilst also shielding and protecting the conductive material 12. The protective positioning of the conductive material 12 reduces the loss of conductivity over time, should the coating have less abrasion resistance than the monofilament itself.

Note the monofilament may be made of any material suitable for the purpose including polymers such as polyester or polyamide or others known to those skilled in the art. Also it should also be noted that the conductive material contemplated has conductivity approaching or equivalent to a metal yarn, can be flexed repeatedly while maintaining the desired conductivity (static dissipation) and has very good adhesion to polymers such as polyester, nylon, polyphenylene sulphide (PPS), polyetherether ketone (PEEK) etc.

Thus by the present invention its objects and advantages are realized, and although preferred embodiments have been disclosed and described in detail herein, its scope and objects should not be limited thereby; rather its scope should be determined by that of the appended claims.

What is claimed is:

1. A static dissipative industrial fabric comprising a plurality of polymeric monofilaments, wherein said monofilaments include electrically conductive material containing metallic particles and a binder incorporated as an outer surface coating or film thereon, said monofilaments having static dissipative properties, wherein the monofilaments include one or more longitudinal grooves, and the conductive material and binder line the one or more longitudinal grooves without filling the longitudinal grooves such that the conductive material and binder form a channel within the longitudinal grooves by forming a film that takes on a substantially similar shape as the longitudinal grooves, and the conductive material and binder reside below a wear surface of the monofilaments, and are located as a continuous coating or film, wherein the conductive material and binder are applied by one of dip or bath coating, spraying, jetting or die coating application method and wherein said fabric is an engineered fabric configured to make nonwoven textiles in airlaid, meltblown or spunbonding processes, or as a papermaking fabric.

2. The fabric in accordance with claim 1, wherein the binder is epoxy, acrylic, vinylidene chloride or copolymers thereof.

3. The fabric in accordance with claim 1, wherein the metallic particles are silver, copper, nickel, zinc or combinations thereof.

4. The fabric in accordance with claim 1, wherein the monofilaments are round or non-round shaped.

5. The fabric in accordance with claim 1, wherein the fabric is woven, MD or CD yarn array, knitted, spiral link assembly, extruded mesh or spiral wound strips of the aforesaid constructions.

6. The fabric in accordance with claim 1, wherein the monofilament is made of polyester, polyamide, polyphenylene sulphide (PPS) or polyetherether ketone (PEEK).

7. The fabric in accordance with claim 1, wherein said fabric is single or multilayered, multilayer woven or laminated.

8. A polymeric monofilament in an industrial fabric said monofilament having a continuous coating or film of conductive material comprised of metallic particles and a binder having static dissipative properties, wherein the monofilament includes one or more longitudinal grooves, and the conductive material and binder line the one or more longitudinal grooves without filling the longitudinal grooves such that the conductive material and binder form a channel within the longitudinal grooves by forming a film that takes on a substantially similar shape as the longitudinal grooves and the conductive material and binder reside below a wear surface of the monofilaments, and are located as a continuous coating or film, and wherein the conductive material and binder are applied by one of dip or bath coating, spraying, jetting or die coating application method, and wherein said monofilament is suitable for use in forming an engineered fabric configured to make nonwoven textiles in airlaid, meltblown or spunbonding processes, or as a papermaking fabric.

9. The monofilament in accordance with claim 8, wherein the binder is epoxy, acrylic, vinylidene chloride or copolymers thereof.

10. The monofilament in accordance with claim 8, wherein the metallic particles are silver, copper, nickel, zinc or combinations thereof.

11. The monofilament in accordance with claim 8, wherein said monofilament is round or non-round shaped.

12. The monofilament in accordance with claim 8, wherein the monofilament is made of polyester, polyamide, polyphenylene sulphide (PPS) or polyetherether ketone (PEEK).

13. The monofilament in accordance with claim 8, wherein said fabric is single or multilayered, multilayer woven or laminated.

* * * * *